US006866529B2

(12) United States Patent
Hobson et al.

(10) Patent No.: US 6,866,529 B2
(45) Date of Patent: Mar. 15, 2005

(54) ADJUSTABLE SEALABLE CONNECTOR

(75) Inventors: Michael Hobson, Fremont, CA (US); Michael Ipsen, Redwood City, CA (US); Christian Weber, Redwood City, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/032,324

(22) Filed: Dec. 20, 2001

(65) Prior Publication Data

US 2002/0102874 A1 Aug. 1, 2002

Related U.S. Application Data

(60) Provisional application No. 60/257,681, filed on Dec. 21, 2000.

(51) Int. Cl.[7] ..... H01R 13/52
(52) U.S. Cl. ..... 439/271; 439/587; 439/281
(58) Field of Search ..... 439/587–589, 439/281–283, 271, 204

(56) References Cited

U.S. PATENT DOCUMENTS

| | | | | | |
|---|---|---|---|---|---|
| 3,678,447 | A | * | 7/1972 | Ziegler, Jr. et al. | 339/60 |
| 3,945,701 | A | * | 3/1976 | Boeke et al. | 339/60 |
| 4,090,759 | A | * | 5/1978 | Herrmann, Jr. | 339/60 |
| 4,600,261 | A | | 7/1986 | Debbaut | 339/116 C |
| 4,645,285 | A | | 2/1987 | Cozzens et al. | 339/96 |
| 4,690,831 | A | | 9/1987 | Uken et al. | 427/44 |
| 4,716,183 | A | | 12/1987 | Gamarra et al. | 522/80 |
| 4,777,063 | A | | 10/1988 | Dubrow et al. | 427/44 |
| 4,810,208 | A | * | 3/1989 | Hayes et al. | 439/589 |
| 4,852,646 | A | | 8/1989 | Dittmer et al. | 165/185 |
| 4,864,725 | A | | 9/1989 | Debbaut | 29/871 |
| 4,865,905 | A | | 9/1989 | Uken | 428/220 |
| 5,079,300 | A | | 1/1992 | Dubrow et al. | 525/106 |
| 5,197,899 | A | * | 3/1993 | Akeda | 439/271 |
| 5,529,508 | A | | 6/1996 | Chiotis et al. | 439/204 |
| 5,588,856 | A | | 12/1996 | Collins et al. | 439/204 |
| 5,934,922 | A | | 8/1999 | Chiotis et al. | 439/204 |
| 6,095,859 | A | | 8/2000 | Maeda | 439/587 |
| 6,325,670 | B2 | * | 12/2001 | Murayama | 439/587 |

FOREIGN PATENT DOCUMENTS

| | | |
|---|---|---|
| EP | 0 204 427 | 12/1986 |
| WO | WO/86/01634 | 3/1986 |
| WO | WO/88/00603 | 1/1988 |

OTHER PUBLICATIONS

Copending U.S. Appl. No. 07/317,703, filed Mar. 1, 1989.
Copending U.S. Appl. No. 07/485,686, filed Feb. 27, 1990.
International Search Report for International Application No. PCT/US01/50410 May 2, 2002.

* cited by examiner

*Primary Examiner*—Truc Nguyen

(57) ABSTRACT

A sealable connector comprises a first connector portion, a second connector portion adapted to engage the first connector portion, a compliant material disposed between the first and second connector portions, and a fastening mechanism that secures the first connector portion to the second connector portion, such that a force applied upon the compliant material by the respective first and second connector portions can be adjusted. The fastening mechanism allows a single connector to be utilized for a variety of applications and allows the connector to be adequately sealed regardless of the manufacturing tolerances of the compliant material.

15 Claims, 5 Drawing Sheets

ADJUSTABLE SEALABLE CONNECTOR

FIELD OF THE INVENTION

The present invention relates generally to electrical connectors and more particularly to a sealable connector that uses an adjustable latching mechanism to maintain an environmental seal.

BACKGROUND OF THE INVENTION

In order to protect electrical connectors from adverse environmental conditions such as moisture, insects, dirt, and corrosion deposits, appropriate seals must be incorporated into their construction. Known connector seals include grommets or similar types of compression seals, heat shrinkable sealing sleeves, greases, epoxies, and gels.

Gel sealants provide several advantages over other known sealing devices and their use with electrical connectors is well known. Gel sealants also provide a way to seal a multi-conductor connector so that the connector can be assembled and sealed, prior to the electrical contacts being inserted into the connector that retains the seal. This arrangement allows a single connector to be used with various arrangements of electrical contacts.

The use of a gel sealant in an electrical connector also allows the electrical contacts within the connector to be removed and re-inserted after the connector has been sealed. This can be accomplished without compromising the integrity of the seal, and without significant degradation of the sealing material. Thus, an electrical contact can be inspected or repaired and the seal will continue to perform after the contact is reinserted.

The use of a gel sealant in an electrical connector also allows the electrical connector to be designed prior to knowing the number of electrical contacts actually needed. Such a generic connector may be utilized in order to allow for various product options or customer configurations. Thus, a connector can be chosen prior to finalizing a customer's specifications and allows a single design to be used for many different connector configurations.

Known gel sealants are effective at sealing electrical connectors. For example, U.S. Pat. Nos. 5,529,508, 5,588,856, and 5,934,922 each describes the use of gel sealants in electrical connectors. The details of each of these patents is hereby incorporated by reference into the present disclosure.

In order to function properly, a gel sealant must be sufficiently compressed within the connector components. This compression allows the gel sealant, which has fluid-like and elastic properties, to readily fill any voids or cracks in the connector. When compressed, the gel sealant wets the surfaces of the connector, displacing any moisture or air, and forms a bond with the connector surfaces.

Experience has shown that gel sealants perform best when they are placed under an initial compression pressure of approximately 1 bar. This initial compression strikes a balance between the viscous and elastic properties of the gel so that the gel will readily fill all voids and cracks within the connector while at the same time allowing the gel to tack against the surfaces of the connector.

Typically, the connector housing and connector cap each have an array of through holes that align the electrical contacts. Since electrical pins or connectors are inserted through these through holes, the gel sealant must contact them. Because there may be a variance in the number of through holes actually used, the surface area that the gel sealant contacts may also vary, and the pressure that the gel grommet requires to effectively seal the connector will change from connector to connector.

While design guides and rules of thumb have been developed for estimating the required pressure on a gel sealant to maintain an effective seal, these estimations are far from exact. Current procedures advise that a prototype connector be manufactured or that stereo lithography be used so that an actual design can be tested. The time and cost associated with these procedures are prohibitive in many applications.

Further, the large tolerances that are present in the manufacture of gel sealants yields a +/−15% variance in the gel's thickness. Thus, even after a new connector is designed and the connector positions are determined, a variation in the gel sealant thickness may result in a wide range of pressures that are required to properly seal the connector. Since known connectors are generally fixed in their positioning relative to the gel sealant, a proper seal may not result if the gel thickness varies too much.

SUMMARY OF THE INVENTION

A sealable connector comprises a first connector portion, a second connector portion adapted to engage the first connector portion, a compliant material disposed between the first and second connector portions, and a fastening mechanism that secures the first connector portion to the second connector portion, such that a force applied upon the compliant material by the respective first and second connector portions can be adjusted.

In a further embodiment, a sealable connector comprises a first connector portion, a second connector portion adapted to engage the first connector portion, a compliant material disposed between the first and second connector portions, and an adjustable fastening mechanism that secures the first connector portion to the second connector portion, the fastening mechanism including means for adjusting a force applied upon the compliant material by the respective first and second connector portions.

Preferably, the fastening mechanism is a ratcheting device or a latch. The latch can comprise a tooth on one of the first or second connector portions and a groove on the other of the first or second connector portions. The tooth is adapted to engage the groove. Alternately, the fastening member comprises a spring biased member.

In a further embodiment, a sealable connector comprises a cup shaped body defining a cavity, the cavity having a bottom surface, a cap adapted to engage the body cavity, an aperture in the cap, the aperture adapted to receive a contact terminal, a compliant material disposed between the body and the cap, and a fastening mechanism that secures the body to the cap, such that a force applied upon the compliant material by the body and the cap can be adjusted.

In another embodiment, a sealable connector comprises a cup shaped body defining a cavity, the body having a bottom surface, a cap adapted to engage the body cavity, the cap including an aperture, a contact terminal extending from the body bottom surface, the contact terminal adapted to align with, and pass through the aperture, a compliant material disposed between the body and the cap, and means for maintaining a consistent pressure on the compliant material, such that the compliant material maintains a substantial seal between the cap and the body.

In a further embodiment, a sealable connector comprises a cup shaped body defining a cavity, the body having a bottom surface, a cap adapted to engage the body cavity, a plurality of apertures in the cap, the apertures adapted to receive a plurality of contact terminals, a compliant material disposed between the body and the cap, and a fastening mechanism that secures the body to the cap such that a force applied upon the compliant material by the body and the cap can be adjusted.

BRIEF DESCRIPTION OF THE DRAWINGS

The drawings illustrate both the design and utility of the preferred embodiments of the present invention, in which similar elements in different embodiments are referred to by the same reference numbers for ease in illustration of the invention, wherein.

DETAILED DESCRIPTION OF THE PREFERRED EMBODIMENTS

Figure 1:
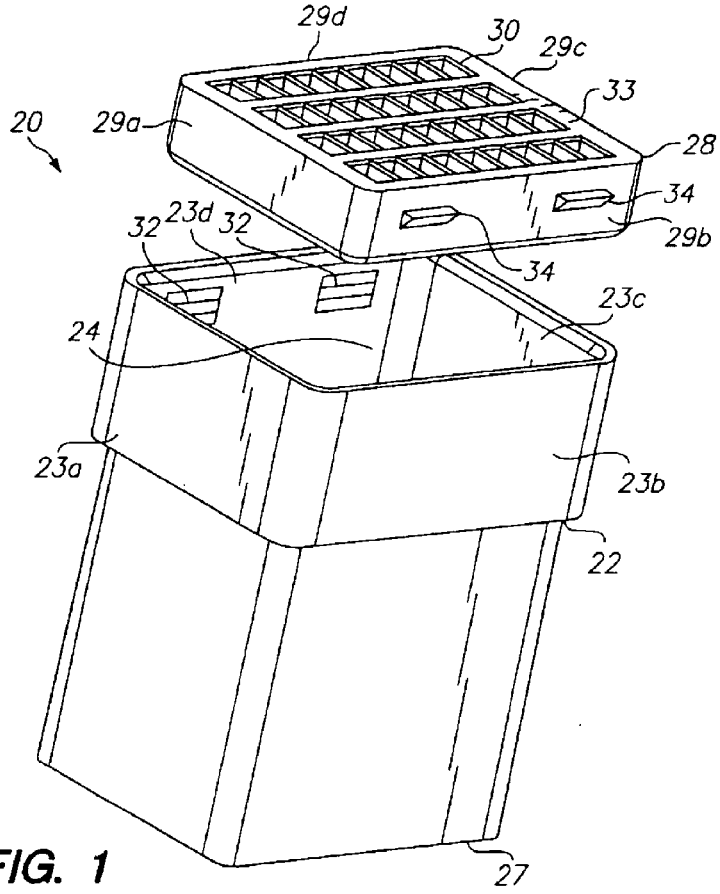
FIG. 1 shows a perspective view of an unassembled connector constructed in accordance with the invention.
Figure 2:
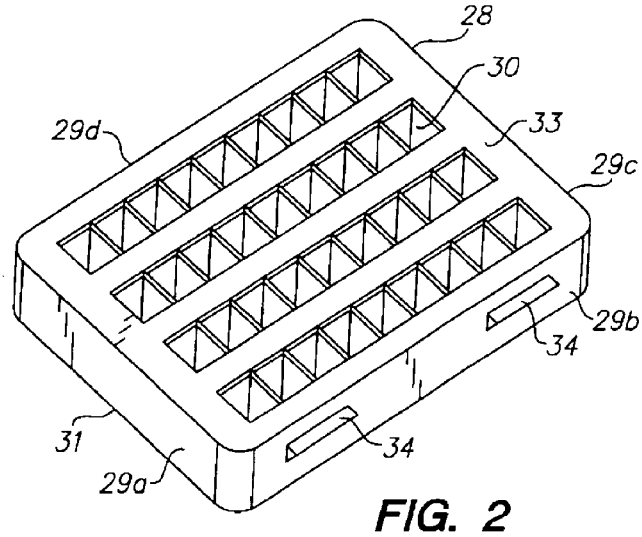
FIG. 2 shows a perspective view of a connector cap constructed in accordance with the present invention.
Figure 3:
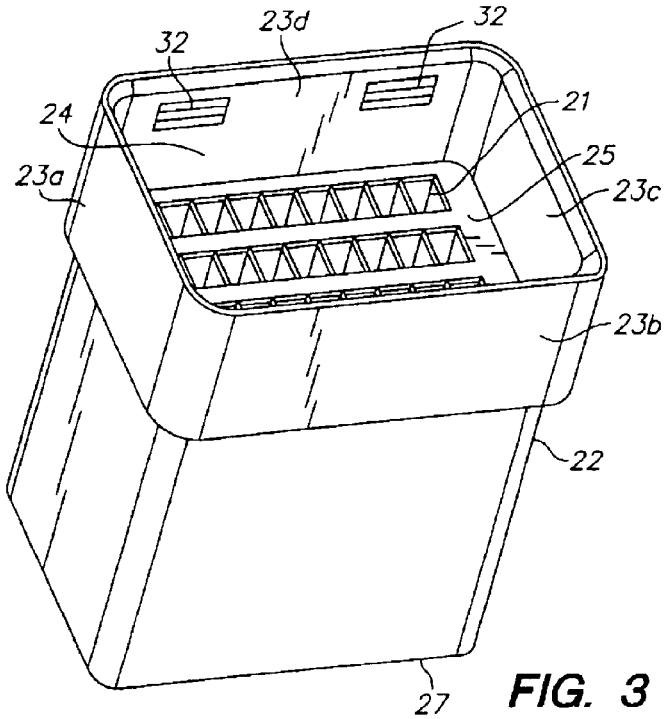
FIG. 3 shows a perspective view of a connector housing constructed in accordance with the present invention.

FIGS. 1–3 show various perspective views of a sealable connector 20 constructed in accordance with the present invention. The sealable connector 20 includes a housing 22 and a cap 28. The housing 22 has a generally rectangular shape, with four side walls 23*a*, 23*b*, 23*c*, and 23*d*, and an interior shelf 25 (best seen in FIG. 3). The top surface of the shelf 25, along with the four side walls 23*a*, 23*b*, 23*c*, and 23*d*, define a cavity 24. The shelf 25 extends across an intermediate position along the height of the housing 22 and includes an array of through holes 21 that extend to a bottom surface 27 of the housing 22.

The cap 28 has a generally rectangular shape, with four side walls 29*a*, 29*b*, 29*c*, and 29*d*, and is adapted to engage within the housing cavity 24. When engaged within the housing cavity 24, the cap side walls 29*a*–29*d* align with the housing side walls 23*a*–23*d*, such that a small gap remains between the cap side walls 29*a*–29*d* and the housing side walls 23*a*–23*d*.

The cap 28 has an array of through holes 30 that extend from a top surface 33 of the cap to a bottom surface 31. When inserted into the housing 22, the through holes 30 in the cap 28 align with the through holes 21 in the housing 22.

The cap 28 includes latching teeth 34 arranged on the cap side walls and the housing 22 includes latching ridges 32 arranged on the inside surface of housing side walls. When the cap 28 is engaged within the housing 22, the latching ridges 32 align with the latching teeth 34 and fasten the cap 28 in the housing 22. Together, the latching teeth 34 and the latching ridges 32 form a ratcheting mechanism that allows the cap 28 to be secured at incremental positions within the housing 22. The height of the cap 28 within the housing cavity 24 can thus be adjusted.

As the cap 28 is advanced into the housing 22, the gel sealant 36 is pressed between the cap 28 and the shelf 25, gradually increasing the pressure on the gel sealant. Additionally, as the cap 28 is advanced, the latching teeth 34 progressively engage the latching ridges 32 until the pressure on the gel sealant reaches a predetermined value. The adjustable nature of the connector allows a connector to be sealed with a gel sealant regardless of the gel's thickness because the height of the cap 28 relative to the housing 22 and the cavity 24 can be adjusted to compensate for any variance in the gel thickness.

The gel sealant 36 is preferably a liquid-extended polymer composition that has a Voland Hardness between 1 and 525 g., more preferably between 5 and 300 g, and most preferably between 5 and 100 g. The gel sealant also preferably has an ultimate elongation, measured according to the procedures of ASTM D217, of at least 50%. Preferably the elongation is 100%. The Voland hardness is measured using a Voland-Stevens Texture analyzer Model LFRA having a 1000 g load cell, a 5 gram trigger, and a ¼ inch (6.35 mm) ball probe. For measuring the hardness of a gel, a 20 ml glass scintillating vial containing 10 grams of gel is placed in the Voland-Stevens Texture analyzer and the stainless steel ball probe is forced into the gel at a speed of 2.0 mm/sec to a penetration distance of 4.0 mm. The Voland Hardness value of the gel is the force in grams required to force the ball probe at that speed to penetrate or deform the surface of the gel the specified 4.0 mm. The Voland Hardness of a gel may be directly correlated to the ASTM D217 cone penetration hardness. These procedures and a correlation are shown in FIG. 3 of U.S. Pat. No. 4,852,646, the details of which are hereby incorporated by reference into the present disclosure.

Additionally, the gel sealant 36 is preferably a liquid-extended polymer network. The polymeric component can be for example, a silicone, polyorgano siloxane, polyurethane, polyurea, styrene-butadiene and/or styrene-isoprene block copolymers. The gel sealant 36 may also be formed from a mixture of such polymers. The gel sealant 36 may alternately comprise a foam or fabric impregnated with the gel. Examples of preferred sealant gels can be found in U.S. Pat. Nos. 4,600,261, 4,716,183, 4,777,063, 4,864,725, and 4,865,905, European published patent application No. 204,427, International published patent applications Nos. WO 86/01634, and WO 88/00603, and commonly assigned U.S. Patent applications Ser. Nos. 317,703 filed Mar. 1, 1989, abandoned in favor of continuation-in-part application Ser. No. 07/488,806, filed Mar. 5,1990, now U.S. Pat. No. 5,079,300, and 485,686 filed Feb. 27,1990, now abandoned. Gel impregnated in a matrix is disclosed in U.S. Pat. Nos. 4,690,831 and 4,865,905. The details of each of the foregoing references are hereby incorporated by reference into the present application.

The gel sealant 36 is preferably resiliently deformable, and when compressed is capable of flowing and conforming around intricate shapes and adhering to solid surfaces. Because of their extremely soft and compliant nature, gels of this type are particularly suitable for sealing items that are slightly warped, manufactured with loose tolerances, manufactured with high surface roughness, or made from materials such as injected molded plastics that contain some or all of the preceding features. Such gels will flow between the surfaces to be sealed, filling the voids and adhering to the surfaces. Such gels are also uniquely suited for sealing because the gel forms a seal upon contact with a surface without the application of undue compressive force, although the gel continues to seal under the application of considerable compressive force.

The gel sealant has self-sealing properties that allows a connector constructed in accordance with the present invention to be sealed either prior to or after the installation of an electrical contact. The self-sealing properties of the gel sealant also allows sealing after removal of the electrical contact.

Figure 4:
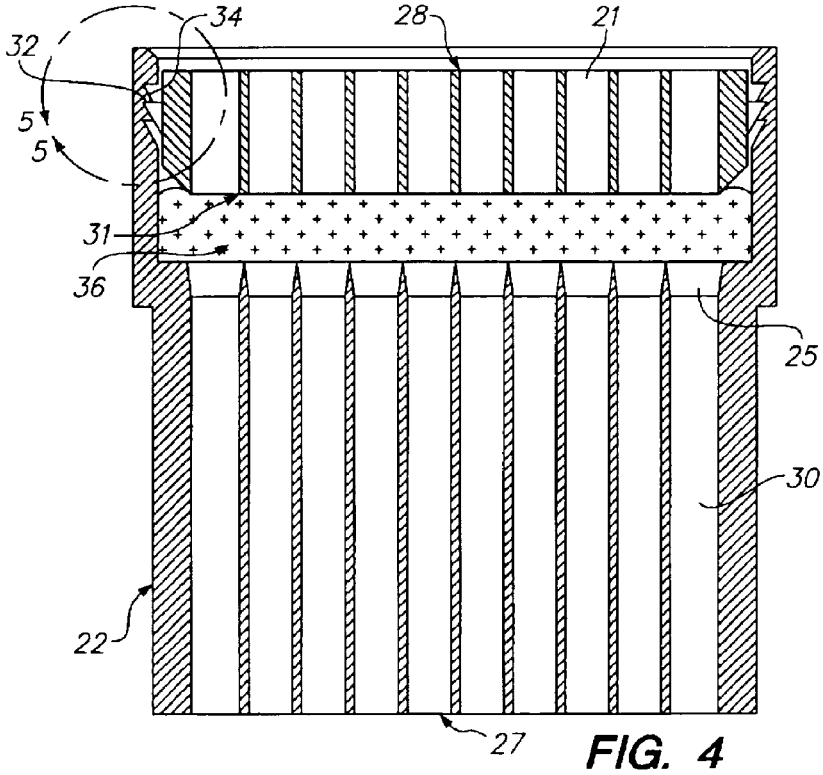
FIG. 4 shows a side cross section of an assembled connector constructed in accordance with the present invention.

In FIG. 4, the cap 28 is secured within the housing cavity 24 by the teeth 34 latching to the ridges 32. The gel sealant 36 is therefore compressed between the cap 28 and the shelf 25. As the cap 28 is advanced into the cavity 24, the teeth 34 engage with subsequent latching ridges 32 and secure the cap in a lower position within the cavity 24, applying a greater pressure to the gel sealant 36. The downward force of the latching ridges and teeth, combined with the upward force of the compressed gel sealant 36, secures the cap 28 in the housing 22. Variances in gel thickness can thus be accounted for without sacrificing the seal that is obtained within the connector.

Figure 6A:
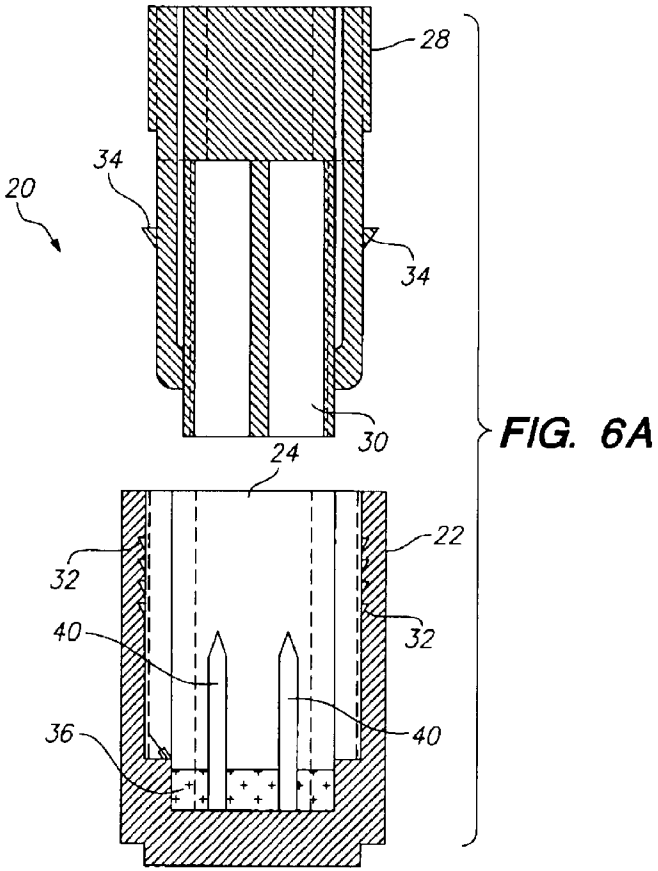
FIGS. 6A and 6B show electrical contacts incorporated into a connector constructed in accordance with the present invention.
Figure 5:
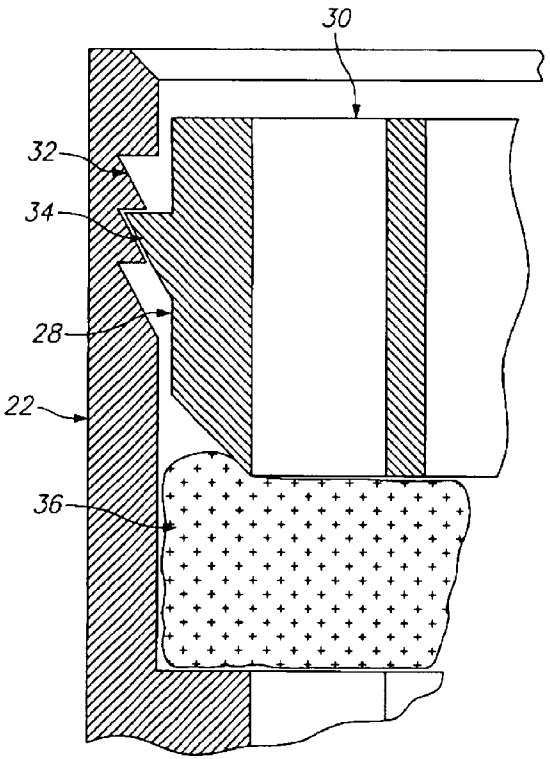
FIG. 5 shows an enlarged cross section of an adjustable latching mechanism used in a connector constructed in accordance with the present invention.
Figure 6B:
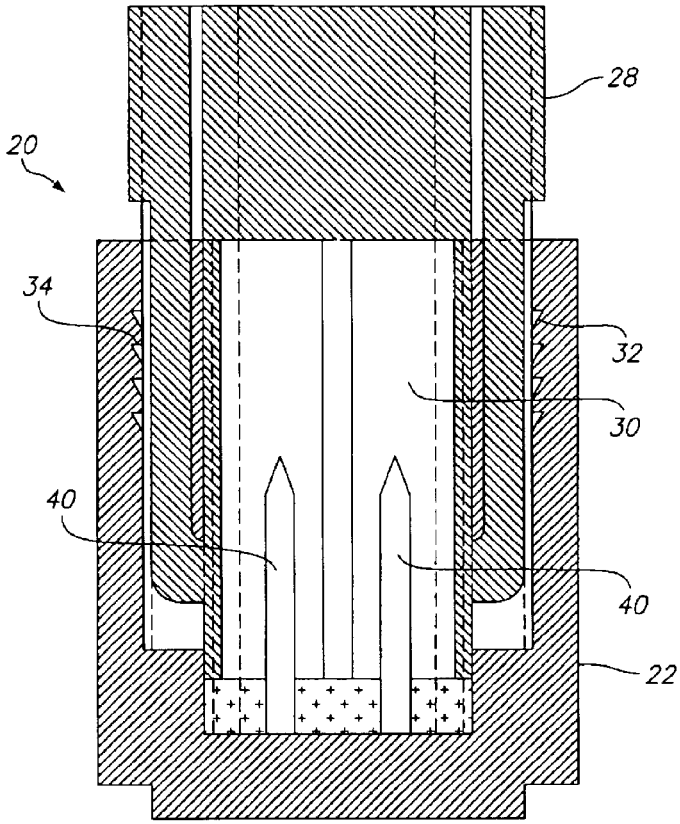

Referring to FIGS. 6A and 6B, a close up view of the connector 20 is shown, and more particularly, illustrating how electrical contacts 40 are inserted through the apertures 21 of the housing 22. With the gel sealant 36 in place, the electrical contacts 40 pierce the gel sealant 36 and extend into the aperture 30 (FIG. 6B). Due to the physical properties of the gel sealant 36 an environmental seal is formed around the electrical contacts 40 so that contaminants can not penetrate into the lower regions of the housing 22.

The cap 28 aligns with the housing 22, and the apertures 21 align with the electrical contacts 40 that extend into the cavity 24. The latching teeth 34 engage the latching ridges 32 to form a ratcheting mechanism that secures the cap 28 within the housing cavity 24 and exerts pressure on the gel sealant 36 such that a seal is maintained between the extended electrical contacts 40 and the lower portion of the housing 22. When the electrical contacts 40 extend through the apertures 30, a female type connection device is formed, providing a receptacle for a complementary connector to be attached.

Figure 8:
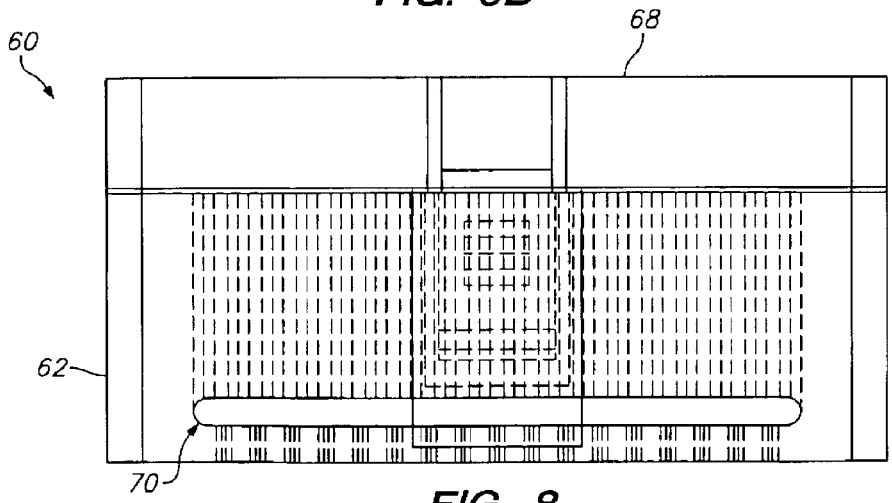
FIG. 8 shows a front cross sectional view of the connector of FIG. 7.
Figure 7:
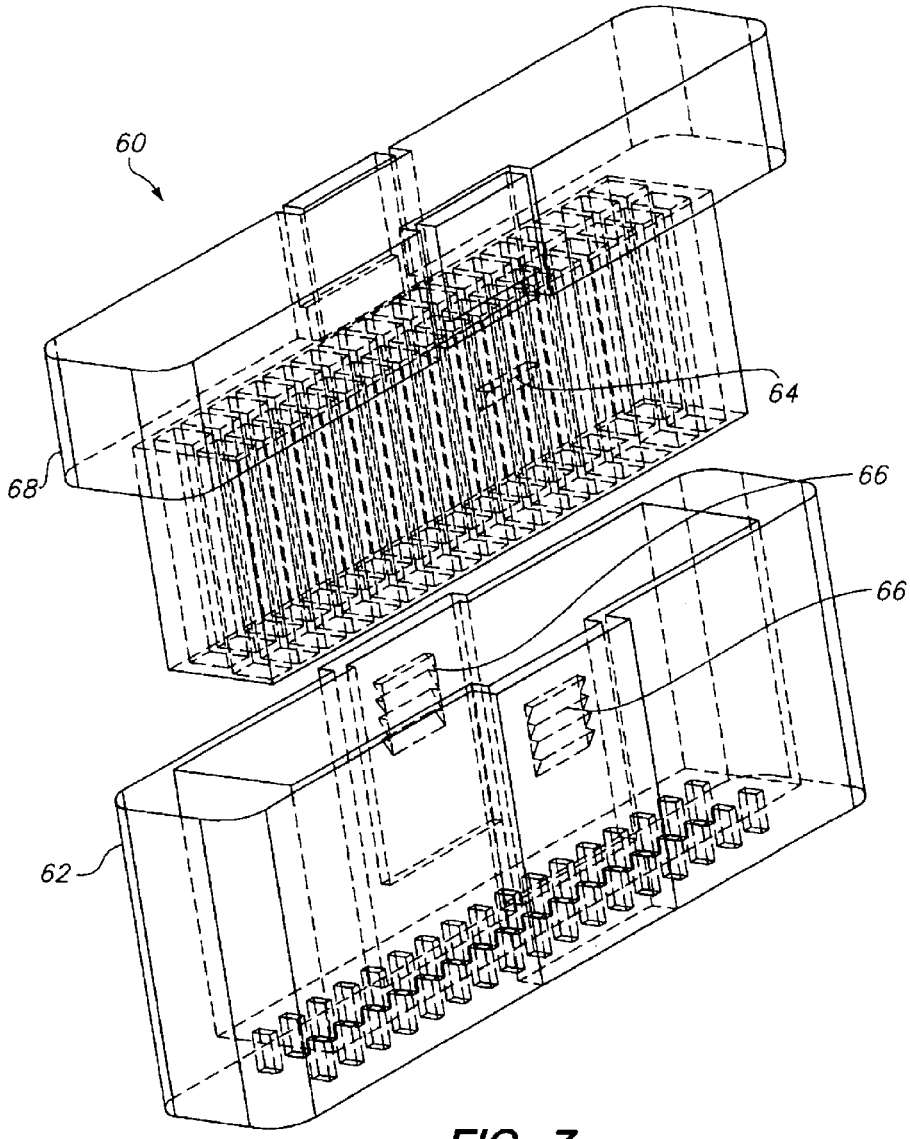
FIG. 7 shows a perspective view of a further embodiment of a connector constructed in accordance with the present invention.

FIGS. 7 and 8 show an alternate embodiment of a sealable connector 60 that includes a cap 68 and a housing 62. The cap 68 includes latching teeth 64 that engage with latching ridges 66 when the cap is inserted into the housing 62. A gel sealant 70 is placed on a lower surface of the housing and forms a seal when the cap 68 is inserted into the housing 62.

Although the invention has been described and illustrated in the above description and drawings, it is understood that this description is by example only and that numerous changes and modifications can be made by those skilled in the art without departing from the scope of the invention. The invention, therefore, is not to be restricted, except by the following claims and their equivalents.

What is claimed is:

1. A sealable connector, comprising:

a first connector portion;

a second connector portion adapted to engage the first connector portion;

a compliant material disposed between the first and second connector portions; and a fastening mechanism that secures the first connector portion to the second connector portion, such that a force is applied upon the compliant material by the respective first and second connector portions and said force can be adjusted in a plurality of incremental pre-set positions.

2. A sealable connector, comprising:

a first connector portion;

a second connector portion adapted to engage the first connector portion;

a compliant material disposed between the first and second connector portions; and an adjustable fastening mechanism that secures the first connector portion to the second connector portion, the fastening mechanism including means for applying a force to the compliant material and adjusting the force in a plurality of incremental pre-set positions when the force is applied upon the compliant material by the respective first and second connector portions.

3. The connector of claim 1, wherein the first connector portion comprises a cup shaped body that defines a cavity, the body having a bottom surface.

4. The connector of claim 3, wherein the second connector portion comprises a cap adapted to fit at least partially within the body cavity.

5. The connector of claim 4, further comprising a contact member extending from the body bottom surface, and a through hole in the cap, wherein the contact member aligns with the through hole when the cap engages the body.

6. The connector of claim 1, wherein the fastening mechanism comprises a ratchet.

7. The connector of claim 1, wherein the fastening mechanism comprises a latch, the latch comprising a tooth on one of the first or second connector portions, the fastening mechanism further comprising a groove on the other of the first or second connector portions, wherein the tooth is adapted to engage the groove.

8. The connector of claim 1, wherein the fastening mechanism comprises a spring biased member.

9. The connector of claim 1, wherein the first and second connector portions, when engaged, form a connection device adapted to mate with a complementary connector.

10. The connector of claim 1, wherein the compliant material forms an environmental seal between the first and second connector portions, when the respective connector portions are engaged.

11. A sealable connector, comprising:

a cup shaped body defining a cavity, the body having a bottom surface;

a cap adapted to engage the body cavity;

an aperture in the cap, the aperture adapted to receive a contact terminal;

a compliant material disposed between the body and the cap; and a fastening mechanism that secures the body to the cap, such that a force is applied upon the compliant material by the body and the cap can be adjusted in a plurality of incremental pre-set positions.

12. The connector of claim 11, wherein the aperture and contact terminal form a female connection device.

13. A sealable connector, comprising:

a cup shaped body defining a cavity, the body having a bottom surface;

a cap adapted to engage the body cavity, the cap including an aperture;

a contact terminal adapted to extend from the body bottom surface, the contact terminal adapted to align with, and pass through, the aperture;

a compliant material disposed between the body and the cap; and means for applying a force and maintaining a consistent pressure on the compliant material and for adjusting the pressure in a plurality of incremental pre-set positions, such that the compliant material maintains a substantial seal between the cap and the body.

14. A sealable connector, comprising:

a cup shaped body defining a cavity, the body having a bottom surface;

a cap adapted to engage the body cavity;

a plurality of apertures in the cap, the apertures adapted to receive a plurality of contact terminals;

a compliant material disposed between the body and the cap; and a fastening mechanism that secures the body to the cap such that a force is applied upon the compliant material by the body and the cap can be adjusted in a plurality of incremental pre-set positions.

15. A sealable connector, comprising:

a first connector portion;

a second connector portion adapted to engage the first connector portion;

a compliant material disposed between the first and second connector portions; and an adjustable fastening mechanism that secures the first connector portion to the second connector portion and exerts a force on the compliant material, the fastening mechanism including means for adjusting the force in a plurality of incremental pre-set positions.

* * * * *